United States Patent [19]

Rinkewich

[11] Patent Number: 4,549,672

[45] Date of Patent: Oct. 29, 1985

[54] DOUBLE-WALL CONTAINER

[76] Inventor: Isaac Rinkewich, 12 Fishman Maimon St., Tel-Aviv, Israel

[21] Appl. No.: 690,186

[22] Filed: Jan. 10, 1985

[51] Int. Cl.[4] ..... B65D 1/44; B65D 1/48; B65D 6/34; B65D 25/18

[52] U.S. Cl. ..... 220/441; 220/71; 220/72; 220/469

[58] Field of Search ..... 220/469, 71, 72, DIG. 15, 220/441; 206/511, 512

[56] References Cited

U.S. PATENT DOCUMENTS

| | | | |
|---|---|---|---|
| 3,005,572 | 10/1961 | Gustafson et al. | 220/72 |
| 3,303,965 | 2/1967 | Parker et al. | 206/512 X |
| 3,307,729 | 3/1967 | Schwartz | 220/72 X |
| 3,407,961 | 10/1968 | Box | 206/511 |
| 3,437,423 | 4/1969 | Mondiadis | 220/469 X |
| 3,441,071 | 4/1969 | Schurman et al. | 220/469 X |
| 3,442,418 | 5/1969 | Strombers | 220/71 |
| 3,987,829 | 10/1976 | Leone | 220/72 X |
| 3,997,074 | 12/1976 | Shead | 220/71 |
| 4,359,168 | 11/1982 | Triadu | 220/71 X |

*Primary Examiner*—Allan N. Shoap
*Attorney, Agent, or Firm*—Benjamin J. Barish

[57] ABSTRACT

A double-wall container comprises outer side walls integrally formed with semi-tubular ribs extending heightwise of the container and joined at their apices to the inner side walls of the container, and an outer bottom wall also integrally formed with semi-tubular ribs which extend transversely of the container and join at their apices to the inner bottom wall. The inner side walls of the container are formed with inwardly-curved corners extending heightwise of the container, and the outer side walls are formed with outwardly-curved corners extending heightwise of the container and complementing the inwardly-curved corners of the inner side walls to define therewith tubular columns at the corners of the container.

20 Claims, 7 Drawing Figures

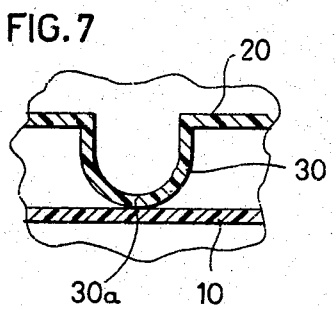
FIG. 7
FIG. 5
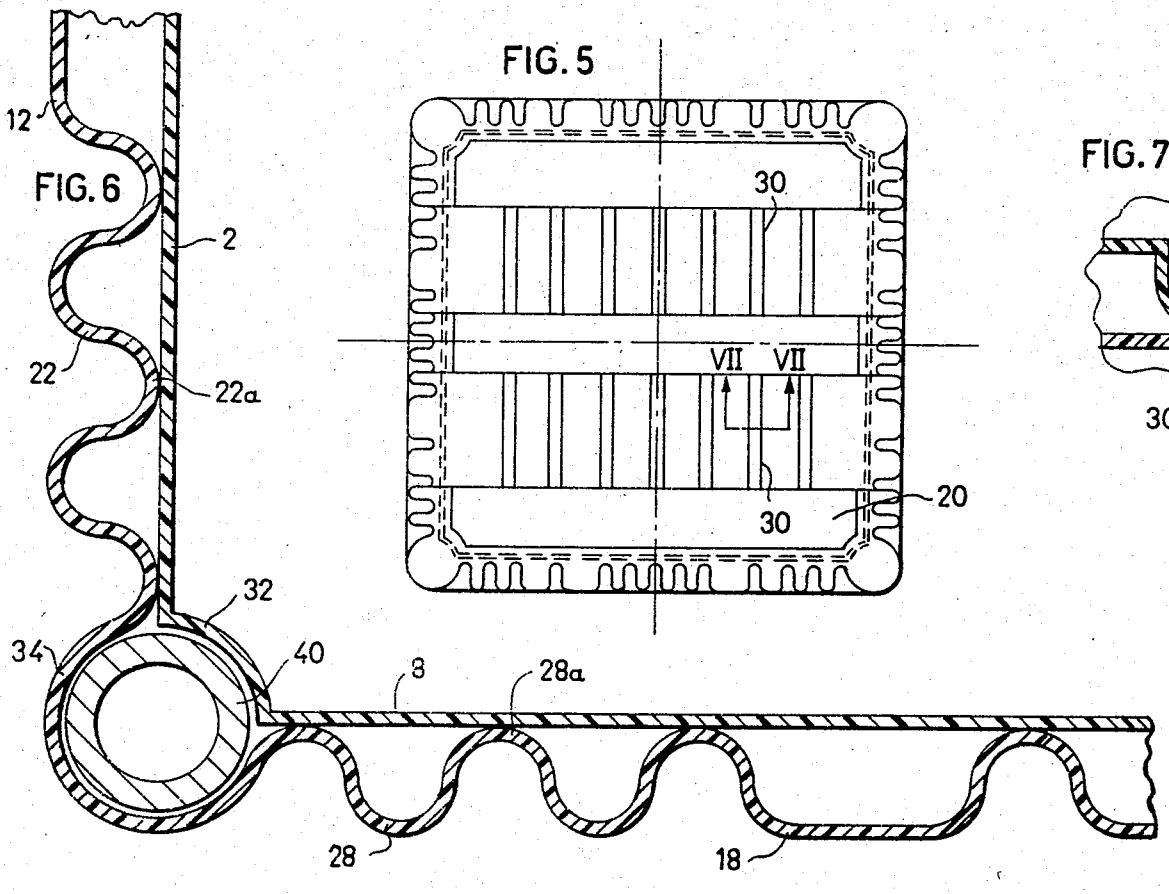
FIG. 6

DOUBLE-WALL CONTAINER

BACKGROUND OF THE INVENTION

The present invention relates to double-wall containers, and particularly to double-wall containers which are for use in storing or transporting various types of goods and which have the capability of supporting loads many times their weight.

Double-wall containers are known having inner and outer side walls joined together in spaced relationship, and inner and outer bottom walls also joined together in spaced relationship. The known constructions, however, are capable of safely supporting only limited loads before danger of collapse of their walls.

An object of the present invention is to provide a double-wall container having a novel structure which very substantially increases the load the container can support without danger of collapse.

BRIEF SUMMARY OF THE INVENTION

According to a broad aspect of the present invention, there is provided a double-wall container including inner and outer side walls joined together in spaced relationship, and inner and outer bottom walls joined together in spaced relationship, the outer side walls being integrally formed with semi-tubular ribs extending heightwise of the container and joined at their apices to the inner side wall of the container.

According to a further feature in the preferred embodiment of the invention described below, the outer bottom wall is also integrally formed with semi-tubular ribs which extend transversely of the container and are joined at their apices to the inner bottom wall of the container.

In the described preferred embodiment, the outer side walls are formed with corrugations of sinusoidal cross-section, such that the semi-tubular ribs are of semi-cylindrical configuration; in addition, the semi-tubular ribs in the bottom wall are also of semi-cylindrical configuration; further, the outer bottom wall is integrally formed with flat sections joining the semi-cylindrical ribs to permit the container to stably rest on a flat supporting surface.

According to still further features in the preferred embodiment of the invention described below, the container is of polygonal cross-section and the inner walls are formed with inwardly-curved corners extending heightwise of the container; in addition, the outer side walls are formed with outwardly-curved corners extending heightwise of the container and complementing the inwardly-curved corners of the inner side walls to define therewith tubular columns, preferably semi-cylindrical columns, at the corners of the containers. The container may further include cylindrical strengthening members, such as metal pipes, received within the cylindrical columns at the corners of the container.

It has been found that the foregoing features permit containers to be constructed of relatively light weight and capable of supporting loads many times, for example up to 50 times, their weight. Such a construction thus permits the containers to be used for transporting or storing various items, e.g., produce, plastic raw material, pharmaceuticals, or the like, by stacking one container on top of the other.

Further features and advantages of the invention will be apparent from the description below.

BRIEF DESCRIPTION OF THE DRAWINGS

The invention is herein described, by way of example only, with reference to the accompanying drawings, wherein:

FIG. 4 is a sectional view, along lines IV—IV of FIG. 1;

FIG. 5 is a bottom plan view of the container of FIG. 1;

FIG. 6 is an enlarged sectional view along lines VI—VI of FIG. 2 and better illustrates the double side wall construction of the container; and FIG. 7 is an enlarged sectional view along lines VII—VII of FIG. 5 and better illustrates the double bottom wall construction of the container.

DESCRIPTION OF A PREFERRED EMBODIMENT

Figures 1, 2, 3:
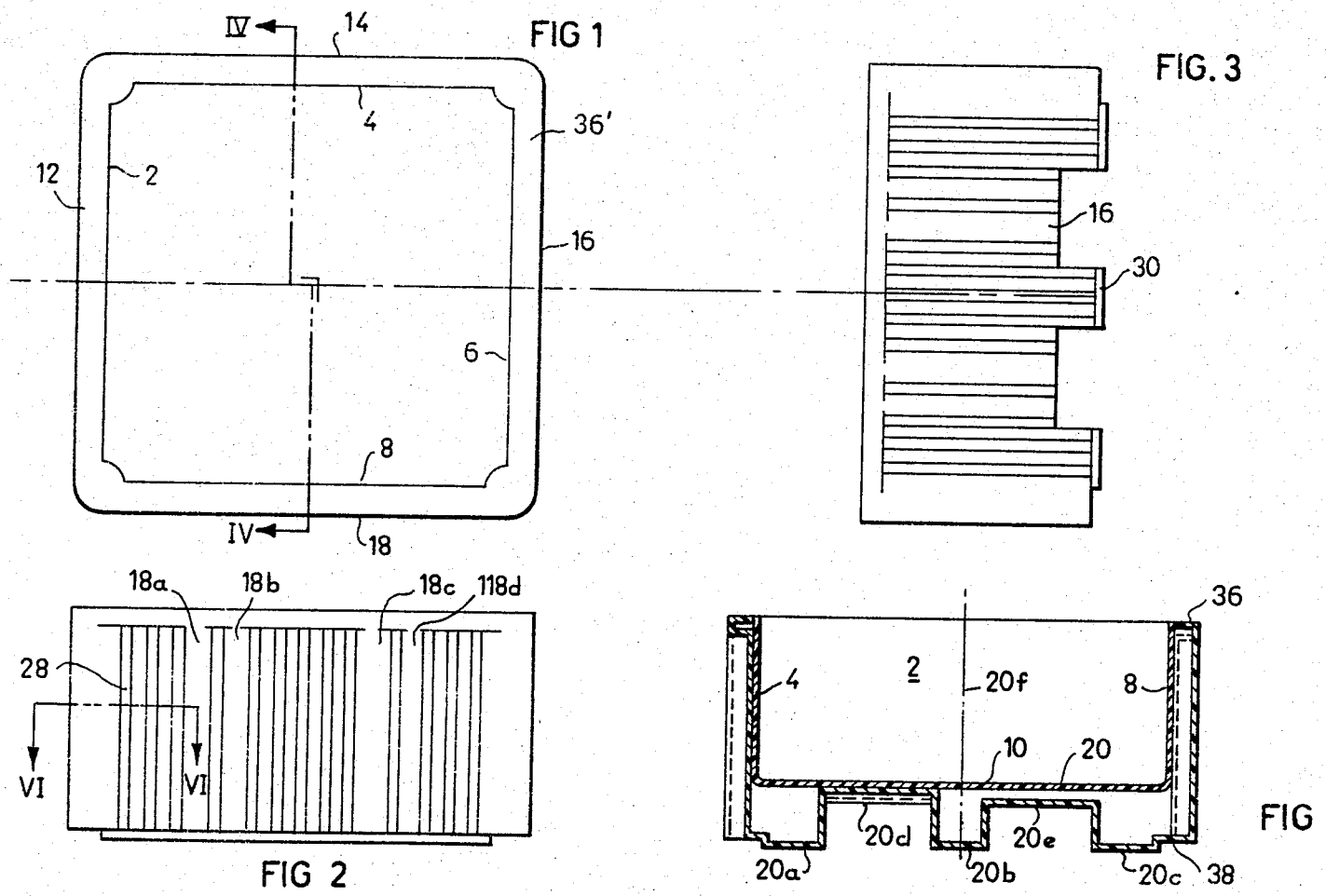
FIG. 1 is a top plan view illustrating one form of double-wall container constructed in accordance with the present invention.
FIG. 2 is a side-elevational view of the container of FIG. 1.
FIG. 3 is an end-elevational view of the container of FIG. 1.

The container illustrated in the drawings is of square cross-section being formed with four sides of equal length, a closed bottom, and an open top. The container is of a double walled construction, including four inner side walls 2, 4, 6, 8 all joined together by an inner bottom wall 10, and four outer side walls 12, 14, 16, 18, all joined together by an outer bottom wall 20. The material to be contained within the container comes into contact with the inner faces of the inner side walls 2, 4, 6 and 8, and inner bottom wall 10, and therefore the inner faces of these inner walls are substantially flat, smooth, and free of sharp corners, ribs or recesses which may tend to mar the goods to be contained in the container. The outer walls 12, 14, 16, 18 and 20 are joined to the inner walls of the container in such manner as to very substantially increase the load the container can support without danger of collapse.

More particularly, the major portions of the side walls 12, 14, 16 and 18 are formed with corrugations 22, 24, 26, 28, respectively, of sinusoidal cross-section thereby defining tubular ribs extending heightwise of the container and joined at their apices to the inner side walls of the container. This is more particularly illustrated in FIG. 6, wherein it will be seen that outer side wall 12 is formed with sinusoidal corrugations 22 joined at their apices **22*a*, namely the valleys of the corrugations, to their respective inner wall 2; and outer wall 18 is similarly formed with sinusoidal corrugations 28 joined at their apices 28*a* to its respective inner wall 28. The ribs defined by these corrugations 22 and 28**, respectively, are of semi-cylindrical configuration and extend the complete height of the container.

As shown particularly in FIG. 2, each side wall (side wall 18 being illustrated in FIG. 2) is not completely corrugated in the above manner, but rather portions of the side-walls, shown at **18*a*, 18*b*, 18*c* and 18*d* in FIG. 2, are left uncorrugated between the corrugated portions 28; these uncorrugated portions have flat inner and outer faces as shown in FIG. 6**.

The outer bottom wall 20 is of stepped configuration, being formed with three extended sections **20*a*, 20*b*, 20*c* (FIG. 4) separating two recessed sections 20*d*, 20*e* on opposite sides of the center axis 20*f*** of the bottom wall.

The recessed sections 20*d*, 20*e* serve as recesses extending transversely across the container for receiving the fork arms of a fork-lift truck. It will be appreciated that the corresponding side walls 12 and 16 are correspondingly stepped at their lower ends, as shown in FIG. 3, for receiving the fork-lift truck arms.

The extended sections 20*a*, 20*b*, 20*c* of the outer bottom wall 20 are formed with flat faces for stably resting the container on a horizontal surface. The recess sections 20*d*, 20*e*, of the outer bottom wall 20 are formed with transversely extending ribs, as shown at 30 in FIGS. 5 and 7, joined at their apices 30*a* (FIG. 7) to the inner bottom wall 10.

The container illustrated in the drawings is of square construction, and therefore includes four corners. One of these corners is particularly illustrated in FIG. 6, wherein it will be seen that the two inner side walls 2 and 8 come together at an inwardly-curved corner 32 which extends heightwise of the container, and the two outer side walls 12 and 18 come together at an outwardly-curved corner 34 also extending heightwise of the container. The inwardly-curved corner 32 and outwardly-curved corner 34 complement each other and together define a tubular column of cylindrical cross-section at the respective corner of the container and extending for its complete height. It will be appreciated that a similar tubular column is formed at each of the three remaining corners of the container.

At the upper end of the container, a peripheral rib 36 is integrally formed with the outer side walls and is joined with the inner side walls so as to define a flat peripheral ledge 36' (FIG. 1). In addition, the outer bottom wall 20 is formed with a peripheral recess 38, as shown in FIG. 4, for receiving the peripheral rib 36 of another like container, in order to permit a plurality of such containers to be stably stacked one on top of the other.

The cylindrical columns defined by the inwardly-curved corners 32 joining the inner walls and the outwardly-curved corners 34 joining the outer walls, together with the semi-tubular ribs defined by the corrugations (e.g. 22, 28) of the outer walls, together inpart very high strength to the container and permit a number of such containers to be stacked one on top of the other without danger of collapse. However, if further strengthening of the container is desired, strengthening cylindrical members, such as metal pipes 40 (FIG. 6), may be inserted in the vertical cylindrical columns formed at the corners of the container by the corner structure 32 of the inner walls and the corner structure 34 of the outer walls, thereby increasing the load that each container is capable of supporting without danger of collapse.

The double-wall container illustrated in the drawings is preferably constructed of plastics material. Many techniques are known that can be used, for example rotational molding or injection molding. If rotational molding is to be used, the complete container can be produced in one section; and if injection molding is used, the container is preferably produced in two sections and joined together in any suitable manner, as by plastic welding or by mechanical fasteners.

While the invention has been described with respect to one embodiment, it will be appreciated that this is described purely for purposes of example, and that the invention may be embodied in other forms. For example, instead of being of four sided cross-section, it could be of polygonal cross-section having a different number of sides, e.g. six sides or eight sides. The container could also be of cylindrical cross-section, in which case the tubular vertical columns, optionally receiving the metal pipes 40, could be formed at spaced points around the circumference of the container, rather than at the corners. Many other variations, modifications and applications of the invention will be apparent.

What is claimed is:

1. A double wall container, including inner and outer side walls joined together in spaced relationship, and inner and outer bottom walls joined together in spaced relationship; said outer side walls being integrally formed with semi-tubular ribs extending heightwise of the container and joined at their apices to the inner side walls of the container.

2. The container according to claim 1, wherein said outer bottom wall is also integrally formed with semi-tubular ribs which extend transversly of the container and are joined at their apices to the inner bottom wall of the container.

3. The container according to claim 2, wherein said outer side walls are formed with corrugations of sinusoidal cross-section such that said semi-tubular ribs are of semi-cylindrical configuration.

4. The container according to claim 3, wherein said semi-tubular ribs in the bottom wall are also of semi-cylindrical configuration.

5. The container according to claim 4, wherein said outer bottom wall is integrally formed with flat sections joining said semi-cylindrical ribs to permit the container to stably rest on a flat supporting surface.

6. The container according to claim 1, wherein said container is of polygonal cross-section, said inner side walls are formed with inwardly-curved corners extending heightwise of the container, and said outer side walls are formed with outwardly-curved corners extending heightwise of the container and complementing said inwardly-curved corners of the inner side walls to define therewith tubular columns at the corners of the container.

7. The container according to claim 6, wherein said tubular columns are of cylindrical configuration.

8. The container according to claim 7, further including cylindrical strengthening members received within said cylindrical columns at the corners of the container.

9. The container according to claim 1, wherein the inner side wall and inner bottom wall have flat, smooth inner faces.

10. The container according to claim 1, wherein the upper end of the outer side walls are formed with a peripheral rib, and the bottom wall is formed with a peripheral recess for receiving the peripheral rib of another like container to permit a plurality of said containers to be stably stacked one on top of the other.

11. The container according to claim 1, wherein the outer bottom wall is formed with two spaced recesses extending transversly across the container on opposite sides of its center axis for receiving the fork arms of a forklift truck.

12. The container according to claim 1, wherein all said walls of the container are of plastic material.

13. The container according to claim, 1, wherein said container is of square cross-section.

14. A double-wall container, including inner and outer walls joined together in spaced relationship, characterized in that said inner walls are formed with inwardly-curved formations extending heightwise of the container and spaced around the periphery of the container, and that said outer side walls are formed with outwardly-curved formations extending heightwise of the container and complementing the inwardly curved formations of the inner walls to define therewith tubular columns spaced around the periphery of the container and extending for the complete height of the container.

15. A container according to claim 14, wherein the container is of polygonal cross-section, said inwardly-curved formations being formed at the corners of the inner side walls, and said outwardly-curved formations being formed at the corners of the outer side walls.

16. The container according to claim 14, further including strengthening members received within said tubular columns formed by said inner and outer side walls.

17. The container according to claim 14, wherein said outer side walls are integrally formed with semi-tubular ribs extending heightwise of the container and joined at their apices to the inner side walls of the container.

18. The container according to claim 17, wherein said outer side walls are formed with corrugations of sinusoidal cross-section such that the tubular ribs are of semi-cylindrical configuration.

19. The container according to claim 18, wherein said semi-tubular ribs in the bottom wall are also of semi-cylindrical configuration, and wherein said outer bottom wall is integrally formed with flat section joining said semi-cylindrical ribs to permit the container to stably rest on a flat supporting surface.

20. The container according to claim 14, wherein said outer bottom wall is also integrally formed with semi-tubular ribs which extend transversely of the container and are joined at their apices to the inner bottom wall of the container.

* * * * *